US008431821B2

(12) United States Patent
Suzuki et al.

(10) Patent No.: US 8,431,821 B2
(45) Date of Patent: Apr. 30, 2013

(54) HERMETICALLY SEALED VACUUM CONTAINER FOR FLUORESCENCE EMITTING TUBE

(75) Inventors: Toshio Suzuki, Chiba (JP); Makoto Akira, Chiba (JP); Koji Tajima, Chiba (JP); Toshimitsu Fuyuki, Chiba (JP); Eiji Morimoto, Chiba (JP); Yawara Inoue, Chiba (JP)

(73) Assignee: Futaba Corporation, Mobara-shi, Chiba (JP)

( * ) Notice: Subject to any disclaimer, the term of this patent is extended or adjusted under 35 U.S.C. 154(b) by 174 days.

(21) Appl. No.: 13/072,156

(22) Filed: Mar. 25, 2011

(65) Prior Publication Data

US 2011/0240326 A1 Oct. 6, 2011

(30) Foreign Application Priority Data

Mar. 31, 2010 (JP) ..... 2010-082381

(51) Int. Cl.
*H01J 5/02* (2006.01)

(52) U.S. Cl.
USPC .... 174/50.5; 174/50.55; 174/520; 174/50.54; 313/544

(58) Field of Classification Search ..... 174/50.54, 174/520, 50.53, 50.5, 50.55; 313/544, 532
See application file for complete search history.

(56) References Cited

U.S. PATENT DOCUMENTS 5,568,013 A * 10/1996 Then et al. ..... 313/532
7,294,954 B2 * 11/2007 Syms ..... 313/103 CM
7,906,725 B2 * 3/2011 Shimoi et al. ..... 174/50.5

FOREIGN PATENT DOCUMENTS

JP 07-302559 11/1995
JP 2003-68189 3/2003

* cited by examiner

*Primary Examiner* — Dhirubhai R Patel
(74) *Attorney, Agent, or Firm* — Quarles & Brady LLP

(57) ABSTRACT

An anode substrate constituted of a conductive film forming substrate and a reinforcing substrate having different thermal expansion coefficient and being bonded together by the arrangement of adhesive layers is disclosed. The substrate can prevent creation of cracks on the conductive film forming substrate when heating and cooling the anode substrate. The adhesive layers are arranged at an interval, each of the adhesive layers being formed into a shape selected from a group consisting of a rectangular strip shape and a curved strip shape. The adhesive layers are arranged in a pattern to be symmetry with respect to a center line of the arrangement of the adhesive layers extending perpendicular to a line connecting both longitudinal ends of the arrangement of the adhesive layer. Furthermore, the adhesive layers include an outer adhesive portion located outward among remaining adhesive layers, and the outer adhesive layers are arranged shorter than the remaining adhesive layers.

3 Claims, 4 Drawing Sheets

HERMETICALLY SEALED VACUUM CONTAINER FOR FLUORESCENCE EMITTING TUBE

CROSS REFERENCE TO RELATED APPLICATION

This application claims priority of Japanese Patent Application No. 2010-082381 and the full contents of that application is incorporated by reference.

TECHNICAL FIELD

The present invention relates to a hermetically sealed vacuum container for a fluorescence emitting tube, such as a fluorescent display tube, more particularly, the present invention relates to a substrate such as an anode substrate constituting the hermetically sealed vacuum container.

BACKGROUND OF THE INVENTION

FIGS. 3A and 3B show a conventional vacuum container of a fluorescent display tube (refer to Japanese Patent Application Publication No. 2003-68189). FIG. 3A is a perspective cross-sectional view of the vacuum container, and FIG. 3B is a cross-sectional view of the vacuum container taken along the line X1-X1 shown in FIG. 3A. The vacuum container is constituted of an anode substrate 11, a front substrate 12 and side plates 13. The anode substrate 11 is provided with a conductive film 14 formed thereon. The conductive film 14 includes an anode electrode made of a thin film forming a fluorescence emitting film and an anode wiring and the like. The vacuum container further includes a cathode electrode C which may be a thermal electron emitting filament. The anode substrate 11, the front substrate 12 and the side plates 13 are made of glass and are integrally bonded together using frit-glass (not shown). Generally, the substrate and the side plate used for the fluorescent display tube are made of soda-lime glass. However, the use of the soda-lime glass to form the anode substrate 11 provided with the thin conductive film 14 may cause a migration problem which leads to a short-circuit between the electrodes and the wirings of the conductive film 14. Therefore, the anode substrate 11 is generally made of high strain point glass in order to prevent the migration problem.

Furthermore, when forming the thin conductive film on the glass plate, it is desirable to use a thin glass plate to reduce the weight to facilitate the handling of the glass plate. Typically, the glass plate has thickness of about 1.8 mm. However, the glass plate having the thickness of about 1.8 mm is not strong enough for the use as the vacuum container of the fluorescent display tube. In view of this problem, Japanese Patent Application Publication No. H07-302559 proposes to provide a reinforcing glass plate bonded to the glass substrate provided with the thin conductive film. FIG. 3C is a cross-sectional view of an example of the conventional vacuum container provided with the anode substrate 11 provided with a reinforcing substrate 112. More specifically, the anode substrate 11 is constituted of a substrate 111 on which the conductive film 14 is formed (hereinafter referred to as a conductive film forming substrate) and the reinforcing substrate 112 bonded to the conductive film forming substrate 111. Using frit-glass 113 applied on the reverse surface of the conductive film forming substrate 111 (opposite to the surface of the substrate 111 on which the conductive film 14 in formed). In the anode substrate 11 fully covered with the frit glass 113 on the reverse surface of the conductive film forming substrate 111 shown in FIG. 3C, air bubbles present between the conductive film forming substrate 111 and the reinforcing substrate 112 cannot be removed or released outside completely when the frit-glass 113 is heated and melted. In addition, the space between the conductive film forming substrate 111 and the reinforcing substrate 112 does not become uniform, because the frit-glass does not spread 113 between the conductive film forming substrate 111 and the reinforcing substrate 112 in an uniform thickness.

In view of the problems relating to the anode substrate 11 explained hereinabove, the inventors of the present invention have proposed an anode substrate 21 provided with strip-shaped frit-glass layers FG applied on a conductive film forming substrate 211 as shown in FIG. 4. FIG. 4A shows a cross-sectional view of the vacuum container having the anode substrate 21, FIG. 4B shows a cross-sectional view of the vacuum container taken along the line X2-X2 shown in FIG. 4A, and FIG. 4C shows the vacuum container of FIG. 4A seen from the direction of the arrow X3 of FIG. 4A in which a reinforcing substrate 212 is eliminated for simplicity. FIG. 4C shows cracks created on the conductive film forming substrate 211.

The vacuum container of FIG. 4A is constituted of the anode substrate 21, the front substrate 22 and the side plates 23. The anode substrate 21 includes the conductive film forming substrate 211, the reinforcing substrate 212, and the strip-shaped frit-glass layers FG constituted of the rectangular strip-shaped frit-glass layers FG1 through FG11. The conductive film forming substrate 211 and the reinforcing substrate 212 are bonded together by means of the strip-shaped frit-glass layers FG1 through FG11. The frit-glass layers FG1 through FG11 are equal in length and arranged at a predetermined interval. Furthermore, the frit-glass layers FG1 through FG11 are arranged so that the respective distance between both longitudinal ends of the frit-glass layers to both transverse ends, namely both upper and lower ends of the conductive film forming substrate 211 shown in FIG. 4B are equal.

The vacuum container of FIGS. 4A and 4B can solve the problems in the vacuum container of FIGS. 3A through 3C by forming the strip-shaped frit-glass layers on the conductive film forming substrate. However, there is still a problem in the vacuum container of FIGS. 4A and 4B. That is, for the vacuum container of FIGS. 4A and 4B, the conductive film forming substrate 211 is made of an expensive glass plate with a high strain point, while the reinforcing substrate 212 is made of the inexpensive soda-lime glass plate in order to reduce the manufacturing cost of the vacuum container. As a result, when the vacuum container is heated and cooled during a sealing process of the vacuum container, cracks are created at the conductive film forming substrate 211 as shown in FIG. 4C. In FIG. 4C, the cracks are created at four locations 211C on the conductive film forming substrate 211 corresponding to the both longitudinal ends of the frit-glass layers FG1 and FG11, namely outermost the terminating ends of the frit-glass layers FG1 through FG 11 frit closest to the side plate 23.

The formation of the cracks is caused by the difference in the thermal expansion coefficient between the conductive film forming substrate 211 and the reinforcing substrate 212 due to excessive stress applied locally at the location 211C when the conductive film forming substrate 211 and the reinforcing substrate 212 having the different thermal expansion coefficient to each other are heated. Further to explanation regarding to the stress applied to the conductive film forming substrate 211 will be explained hereinafter. In this regard, the thermal expansion coefficient of the soda-lime glass is $93\times10^{-7}$/degrees Celsius, the high strained point glass is $85\times10^{-7}$/degrees Celsius and the frit-glass is $78\times10^{-7}$/degrees Celsius.

SUMMARY OF THE INVENTION

In view of the above problems, an object of the present invention is to provide an anode substrate which can prevent cracks from forming on a conductive film forming substrate by bonding the conductive film forming substrate and a reinforcing substrate having different thermal expansion coefficient to each other by strip-shaped frit-glass layers.

In order to achieve the above object, the present invention provides a hermetically sealed vacuum container for a fluorescence emitting tube which comprises a substrate on which a conductive film is formed, a strip-shaped adhesive layers and a reinforcing substrate. The conductive film forming substrate and the reinforcing substrate having different thermal expansion coefficient are bonded together by a plurality of strip-shaped adhesive layers arranged at an interval. The adhesive layers are formed into a shape selected from a group consisting of a rectangular strip shape and a curved strip shape. The strip-shaped adhesive layers arranged in a pattern to be symmetry with respect to the center line of the strip-shaped adhesive layers extending perpendicular to the line connecting both longitudinal ends of the strip-shaped adhesive layers. Furthermore, the strip-shaped adhesive layers include outer adhesive layers located outward among remaining adhesive layers, and the outer adhesive layers are arranged to be shorter than the remaining adhesive layers.

Furthermore, the conductive film forming substrate may be made of high strain point glass, the reinforcing substrate may be made of soda-lime glass and the strip-shaped adhesive layers may be made of frit-glass.

The strip-shaped adhesive layers include at least two outer adhesive layers on both sides of an array of the adhesive layers, length of which becomes shorter in a stepwise toward the outside.

As described above, the substrate used for the vacuum container according to the present invention is constituted of the conductive film forming substrate and the reinforcing substrate having different thermal expansion coefficient and bonded together by the strip-shaped adhesive layers made of grit glass. Since the frit-glass layers arranged at an interval includes the outer frit-glass layers which are shorter than the remaining frit-grass layers, the stress to be applied to the conductive film forming substrate can disperse, thereby reducing the stress applied to one portion on the conductive film forming substrate. Consequently, even the conductive film forming substrate and the reinforcing substrate having different thermal expansion coefficient are bonded together using the strip-shaped frit-glass layers, the cracks on the conductive film forming substrate can be prevented. Furthermore, by arranging the outer adhesive layers to be shorter in a stepwise manner, the stress applied to one portion on the conductive film forming substrate can be significantly reduced. Thus, the cracks on the conductive film forming substrate can be prevented effectively. Furthermore, the curved frit-glass layers can significantly reduce the stress applied on the conductive film forming substrate.

According to the present invention, the conductive film forming substrate and the reinforcing substrate are bonded together by the strip-shaped frit-glass layers. Thus, air bubbles present between the conductive film forming substrate and the reinforcing substrate can be completely released outside during the heating and melting process of the frit-glass. In addition, the thickness of the frit-glass layer between the film conductive substrate and the reinforcing substrate can be uniform.

BRIEF DESCRIPTION OF THE DRAWINGS

FIGS. 1A and 1B are schematic plan views of an anode substrate of a vacuum container according to the present invention, in which FIG. 1A illustrates an embodiment strip-shaped frit-glass layers formed on a conductive film forming substrate and FIG. 1B illustrates another embodiment of strip-shaped frit-glass layers;

FIGS. 2A through 2D are schematic plan views of an anode substrate of a vacuum container of the present invention illustrating the stress distribution at the conductive film forming substrate of the anode substrate, in which FIGS. 2A and 2B illustrate a conventional anode substrate;

DETAILED DESCRIPTION OF THE PREFERRED EMBODIMENT

An embodiment of the present invention will be described below in reference with FIGS. 1A, 1B and FIGS. 2A through 2D.

Figure 1A:
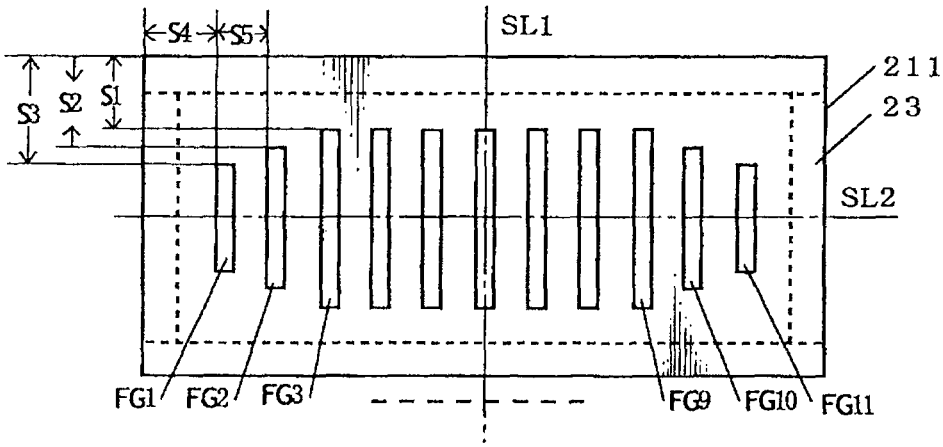
Figure 4A:
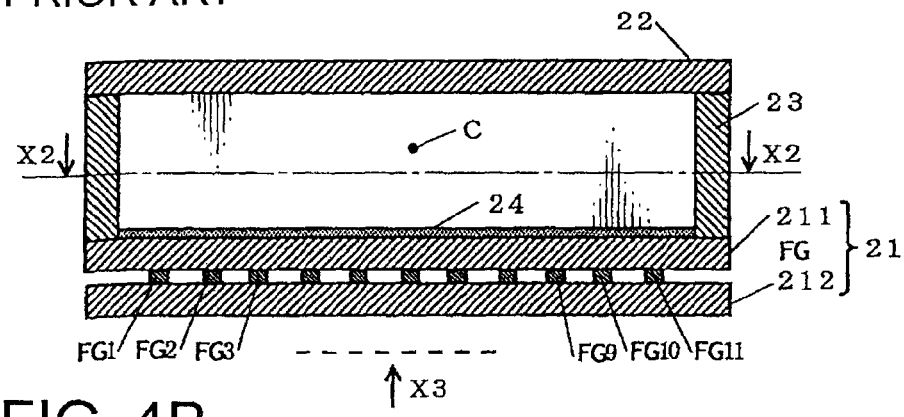
FIG. 4A PRIOR ART
FIGS. 4A through 4C are a vertical cross-section, a horizontal cross-section, and a plan view of another conventional vacuum container provided with an anode substrate having a conductive film forming substrate and a reinforcing substrate bonded together by mean of strip-shaped frit-glass layers.
Figure 4B:
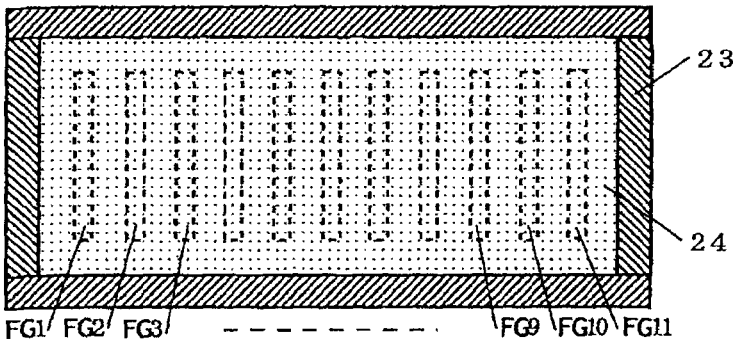
FIG. 4B PRIOR ART

FIG. 1A shows an embodiment of a substrate 211 provided with a conductive film (not shown) constituting a vacuum container of the present invention. The basic structure of the vacuum container of the present invention shown in FIG. 1 is similar to a conventional vacuum container shown in FIG. 4A. Thus, the same reference numerals are used to indicate the similar components. As shown in FIG. 1, the vacuum container of the present invention is constituted of a front substrate (not shown), side plates 23 and an anode substrate on which a conductive film are formed, a reinforcing substrate and a strip-shaped frit-glass layers FG1 through FG11. The conductive film forming substrate 211 and the reinforcing substrate are bonded together by the strip-shaped frit-glass layers FG1 through FG11. The conductive film forming substrate 211 may be made of high strain point glass while the reinforcing substrate may be made of other glass such as soda-lime glass.

As shown in FIG. 1A, the frit-glass layers FG1 through FG11 are is formed into a rectangular strip shape. The frit-glass layers FG1 through FG11 are arranged on the reverse surface of the conductive film forming substrate 211 at a predetermined interval corresponding to the opposite surface of the substrate 211 on which the conductive films are formed. Among the frit-glass layers FG 1 through FG11, the frit-glass layers FG1 and FG11 located outermost adjacent to the side plate 23 have shortest longitudinal length, and FG2 and FG 10 next to the frit glass layers FG1 and FG11 are longer than the frit-glass layers FG1 and FG11 but shorter than the remaining frit-glass layers FG3 through FG 9 located inward. Thus, the frit-glass layers FG1 through FG 11 are arranged so as to satisfy the equation of FG1=FG11<FG2=FG10<FG3=FG4=FG5=FG6=FG7=FG8=FG9.

Each of the frit-glass layers FG1 through FG 11 extends along the vertical central line SL1. As shown in FIG. 1A, the vertical central line SL1 passes through the frit-glass layer FG6 located at the center of the grit glass layers FG1 through FG11, however, if the number of the frit layers is even, then the vertical central line passes through between two centrally located frit-glass layers. Furthermore, the center of each frit-glass layers FG1 through FG 11 is arranged side by side along the horizontal central line SL2. Accordingly, the strip-shaped frit-glass layers are arranged to be symmetric with respect to the vertical central line SL1. In other words, an arrangement of the frit-glass layers FG1 to FG 5 and an arrangement of the frit-glass layers FG7 to FG 11 are symmetric with respect to the vertical central line SL1. The vertical and the horizontal central lines SL1 and SL2 are arranged to intersect orthogonally at the center of the conductive film forming substrate 211.

By providing the strip-shaped frit-glass layers of shorter length on the both the frit-glass layers FG 1 through FG11, the stress applied to the conductive film forming substrate 211 disperses so that the stress is applied to the locations on the conductive film forming substrate 211 corresponding to the both ends of the frit-glass layers FG1, FG2 and FG3, and FG9, FG10, and FG11, and the stress becomes relatively small at that locations. As the result, production of cracks can be prevented. The number of the frit-glass layers is not limited to that disclosed herein. Also, the number of the shorter frit-glass layer may be selected arbitrarily, but it should be at least 1. The greater the number of the shorter frit-glass layers, the smaller the chance of the cracks being created, since the stress applied to the conductive film forming substrate can be dispersed according to the number of the shorter frit-glass layers.

In this embodiment shown in FIG. 1A, the conductive film forming substrate 211 is 91×44 mm in size and 1.8 mm in thickness. The reinforcing substrate (not shown) is 91×44 mm in size which is the same as the conductive film forming substrate 211 and 1.3 mm in thickness. The side plate 23 is 2.35 mm in thickness and 3.5 mm in height. The width of each of the frit-glass layers FG1 through FG11 is 2 mm. A distance S1, S2 and S3 (shown in FIG. 1A) corresponding to the distance from the transverse end of the conductive film forming substrate 211 to the longitudinal end of each of the respective frit-glass layers FG3, FG2 and FG1 is S1=8.35 mm, S2=11.35 mm and S3=15.35 mm. The distance S1 is the same for the frit-glass layers FG3 through FG9. A distance S4 (shown in FIG. 1A) from the longitudinal end of the conductive film forming substrate 211 to the transverse end of the frit-glass portion FG1 is S4=8.35 mm. A space between each of the frit-glass layers S5 is S5=7.18. However, these sizes and distances are only examples and may be chosen arbitrarily. Although in this embodiment shown in FIG. 1A, the frit-glass layers FG1 through FG11 are arranged so that the longitudinal direction thereof extends along the vertical central line SL1, the longitudinal direction of the frit-glass layers FG1 through FG11 may extend along the horizontal central line SL2.

Figure 1B:
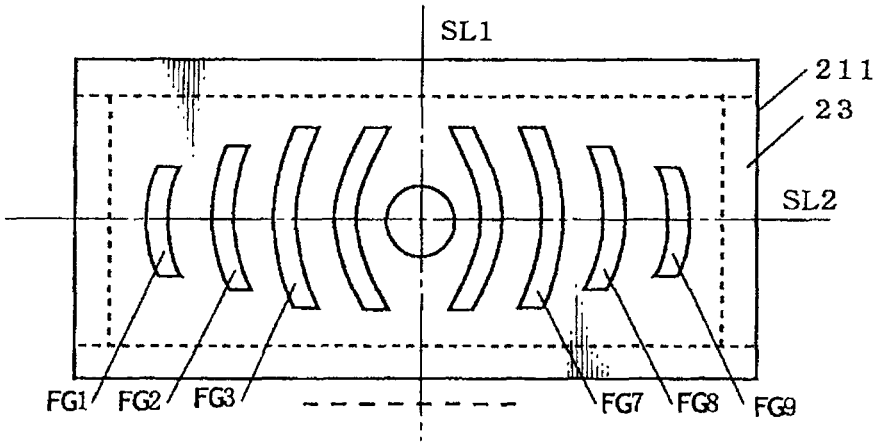

Another embodiment of the present invention will be explained with reference to FIG. 1B. In this embodiment, the same reference numerals are used for the components similar to those of the embodiment shown in FIG. 1A. FIG. 1B shows another embodiment of an arrangement of the frit-glass layers FG1 through FG9. The frit-glass layers FG1 through FG 9 are arranged at a predetermined interval with respect to each other. Each of the frit-glass layers FG1 through FG 4 and FG 6 through FG9 is arranged into a curved rectangular strip-shaped and concaved toward the side plate 23. More specifically, a pair of the frit-glass layers FG1 and FG9, FG2 and FG8, FG3 and FG7 as well as FG4 and FG6 are arranged in an arc of an ellipsoid or a circle fashion on both sides of the center of the conductive film forming substrate 211. There is also provided a frit-glass layer FG5 arranged into a circular shape and located at the center of the conductive film forming substrate 211. The shape of the frit-glass layer FG5 may be formed into other shapes such as an ellipsoidal shape and rectangular shape. The frit-glass layers FG2 and FG8 are arranged shorter than the frit-glass layers FG3 and FG7, as well as the frit-glass layers FG1 and FG9 are arranged shorter than the frit-glass layers FG2 and FG8. The strip-shaped frit-glass layers are arranged in a pattern to be symmetric with respect to the vertical central line SL1. In other words, the arrangement of the frit-glass layers FG1 to FG 4 is symmetric to the arrangement of the frit-glass layers FG6 to FG 9.

According to this embodiment, since the frit-glass layers FG1 through FG4 and FG6 through FG9 are formed into the curved shape, the stress applied to the conductive film forming substrate 211 becomes smaller than that of the embodiment having the frit-glass layers FG1 through FG11 shown in FIG. 1A which are not curved. As a result, the creation of a crack can be prevented more effectively.

In the above embodiments, the frit-glass layers FG1 through 11 of FIG. 1A and the frit-glass layers FG1 through FG9 of FIG. 1B are located on the reverse surface of the conductive film forming substrate 211 within a range defined by the side plates 23. Furthermore, the high strain point glass used to form the conductive film forming substrate 211 may be alkali-free glass or low-alkali-free glass. Furthermore, the conductive film forming substrate and the reinforcing substrate do not need to be made of glass and may be made of insulating material. Furthermore, the frit-glass used to form the frit-glass layers may be replaced with an adhesive including insulating material other than glass.

Figure 2A:
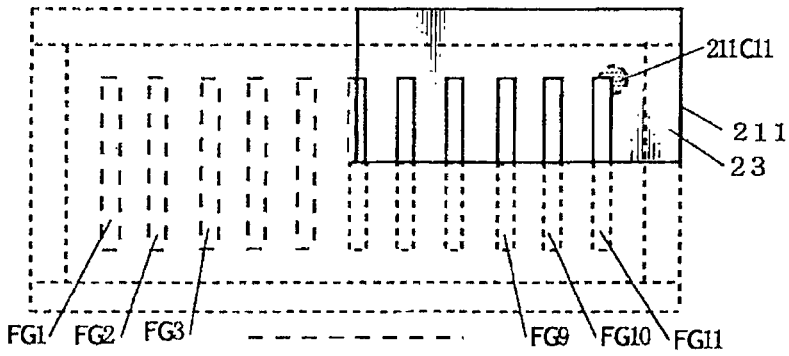
Figure 2B:
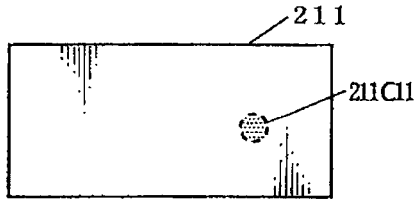
Figure 2C:
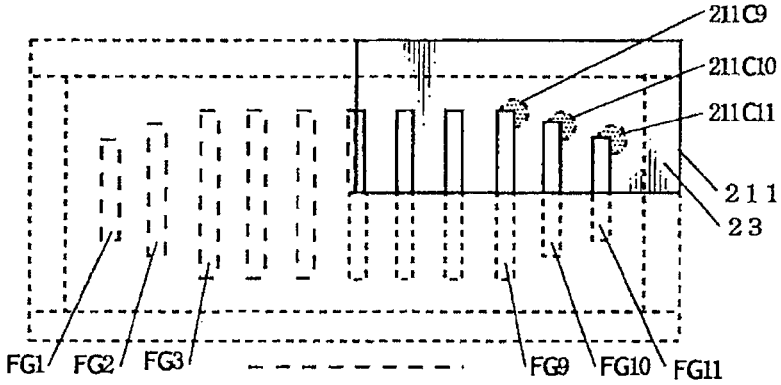
Figure 2D:
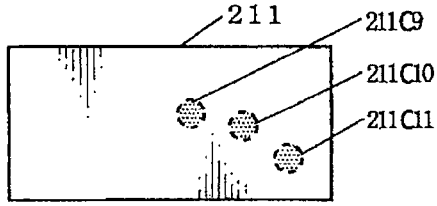
Figure 3A:
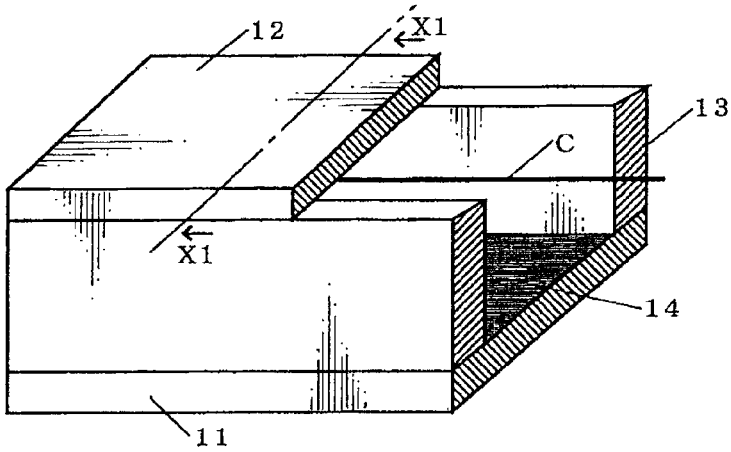
FIG. 3A PRIOR ART
FIGS. 3A, 3B, and 3C are a perspective, a cross-section, and a partially broken cross-section views of a conventional vacuum container of a fluorescent display tube respectively.
Figure 3B:
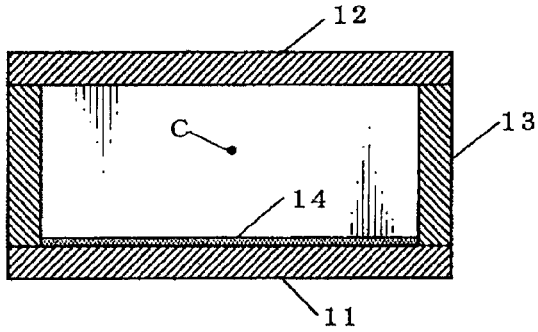
FIG. 3B PRIOR ART
Figure 3C:
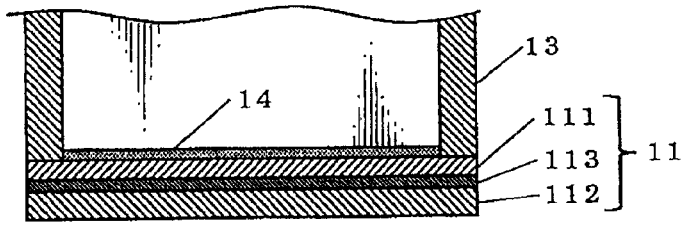
FIG. 3C PRIOR ART
Figure 4C:
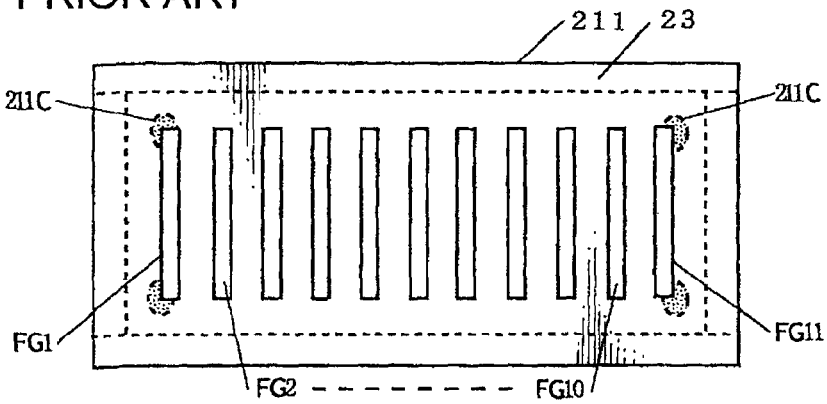
FIG. 4C PRIOR ART

The results obtained through a simulation of stress distribution at the conductive film forming substrate will be explained with reference to FIGS. 2A through 2D. FIG. 2A shows the conventional film substrate having a conventional arrangement of frit-glass layer shown in FIG. 4C. FIG. 2B shows the stress distribution resulted from the strip-shaped frit-glass layer of FIG. 2A. FIG. 2C shows the conductive film forming substrate 211 according to the present invention having the arrangement of frit-glass layer shown in FIG. 1A. FIG. 2D shows the stress distribution resulted from the arrangement of frit-glass of FIG. 2D.

The simulation was performed according to a finite element method. The following describes conditions for the simulation. The conductive film forming substrate 211 and the reinforcing substrate 212 are bonded together by means of the frit-glass layers FG1 through FG11 to from the anode substrate 21, and the side plates 23 are bonded to the anode substrate. The simulation was performed for a 114 portion of the anode substrate 21 (indicated by the solid line in FIGS. 2A and 2C). The size of the conductive film forming substrate 211, the reinforcing substrate 212 and the frit-glass layers FG1 through FG11 are the same as the embodiment shown in FIG. 1A, except the height of the side plate 23 is set to 1.75 mm. Furthermore, the conductive film forming substrate 211 and the reinforcing substrate 212 were bonded together by heating the anode substrate 21 to melt the frit-glass followed by cooling the anode substrate 21 down to a room temperature (25 degrees C.). The melted frit-glass solidifies at a temperature of 380 degrees C.

In the arrangement of frit-glass layers shown in FIG. 2A, a stress (a tensile stress) applied to the conductive film forming substrate 211 becomes greatest at the location 211C11 which is adjacent to the longitudinal end of the frit-glass layers FG11 as shown in FIGS. 2A and 2B, and the maximum value of the stress is about 3.801 kgf/mm$^2$(37.3 MPa). In the arrangement of frit-glass layers shown in FIG. 2C, the stress applied to the conductive film forming substrate 211 shows peaks at the locations 211C9, 211C10 and 211C11 corresponding to the longitudinal end of each of the frit-glass layers FG9, FG10 and FG11 as shown in FIGS. 2C and 2D, while the stress induced at the location 211C11 being the greatest. The maximum value of the stress at the location 211C11 is about 1.876 kgf/mm$^2$(18.4 MPa). The stress at the respective peaks described above becomes smaller in order of the stress at the location 211C11, 211C10 and 211C9, the stress at the locations 211C9 being the smallest.

From the results obtained through the foregoing simulation, it is observed that, by employing the arrangement of frit-glass layers FG1 through FG11 with the outer frit-glass layers which are shorter than the other frit-glass layers, the peak of the stress on the conductive film forming substrate 211 disperses to several locations on the conductive film forming substrate 211, with the stress at each peak being relatively small. Consequently, creation of a crack on the conductive film forming substrate 211 can be prevented.

In the embodiments explained hereinabove, the anode substrate is provided with the conductive film including the anode electrode and the anode wiring, however, the conductive film may be provided to both of the anode substrate and the front substrate. Although the rectangular conductive film forming substrate is shown, the conductive film forming substrate may be formed into various shapes but the shape need to be rectangular, e.g. square, rhombus, trapezoid or parallelogram. In addition, the conductive film forming substrate does not need to be the same in size with the to reinforcing substrate. Furthermore, in the embodiments described herein, the vacuum container includes at least four rectangular side plates. However, the four side plates may be formed in one, or in case of not forming the conductive film on to the front substrate, the side plates and the front substrate may be formed in one to form a cap shape.

According to the embodiments of the present invention, each of the frit-glass layers FG1 through FG11 is formed continuously, however the rectangular frit-glass layers may be formed with a plurality of dots. In addition, the fluorescent display tube described herein may be provided with a field emission cathode instead of the thermal-electron emitting filament. In addition, the present invention may be applied to other fluorescence emitting tube or device such as, an image display device or a light source having a vacuum container.

The embodiments described herein are only representative embodiments and are not intended to limit the present invention. It will be understood that various modifications to the embodiments may be made without departing the frame of the present invention.

What is claimed is:

1. A vacuum container for a fluorescence emitting tube comprising a conductive film forming substrate, adhesive layers and a reinforcing substrate, wherein the conductive film forming substrate and the reinforcing substrate having different thermal expansion coefficient are bonded together by the adhesive layers, wherein the adhesive layers are arranged at an interval, each of the adhesive layers being formed into a shape selected from a group consisting of a rectangular strip shape and a curved strip shape, wherein the adhesive layer is arranged in a pattern to be symmetry with respect to a center line of the adhesive layers extending perpendicular to a line connecting both longitudinal ends of the adhesive layers, and wherein the adhesive layers include outer adhesive layers located outward among remaining adhesive layers, and the outer adhesive layers are arranged to be shorter than the remaining adhesive layers.

2. The vacuum container of the fluorescence emitting tube described in claim 1, wherein the conductive film forming substrate is made of high strain point glass and the reinforcing substrate is made of soda-lime glass and the adhesive layers are formed by frit-glass.

3. The vacuum container of the fluorescence emitting tube described in claim 1 or 2, wherein the adhesive layers include at least two outer adhesive layers said outer adhesive being shorter in length toward outside in a stepwise.

* * * * *

UNITED STATES PATENT AND TRADEMARK OFFICE

CERTIFICATE OF CORRECTION

PATENT NO. : 8,431,821 B2
APPLICATION NO. : 13/072156
DATED : April 30, 2013
INVENTOR(S) : Suzuki et al.

It is certified that error appears in the above-identified patent and that said Letters Patent is hereby corrected as shown below:

In the Specifications:

Col. 2, line 64 "further to explanation" should be changed to -- further explanation --

Col. 4, line 53 "are is formed" should be changed to -- are formed --

Col. 7, line 32 "the to reinforcing" should be changed to -- the reinforcing --

Signed and Sealed this
Ninth Day of July, 2013

Teresa Stanek Rea

Teresa Stanek Rea
*Acting Director of the United States Patent and Trademark Office*